United States Patent [19]

Lisiecki et al.

[11] Patent Number: 4,784,272

[45] Date of Patent: Nov. 15, 1988

[54] FLAT TOP CONTAINER AND BLANK FOR CONSTRUCTING SAME

[75] Inventors: Robert E. Lisiecki, Bloomfield; Richard A. Miller, Detroit; David M. Majewski, Northville, all of Mich.

[73] Assignee: Pure-Pak Inc., Walled Lake, Mich.

[21] Appl. No.: 134,838

[22] Filed: Dec. 18, 1987

[51] Int. Cl.[4] ..... B65D 5/54

[52] U.S. Cl. ..... 206/628; 206/620; 206/633; 229/125.42; 229/160.2

[58] Field of Search ..... 229/132, 137, 138, 160.2, 229/125.42; 206/620, 628, 621.3, 633

[56] References Cited

U.S. PATENT DOCUMENTS 2,819,832 1/1958 Stoller et al. ..... 206/621.3
3,038,651 6/1962 Cloudsley ..... 206/620
4,520,930 6/1985 Lisiecki ..... 206/633

FOREIGN PATENT DOCUMENTS 730539 3/1966 Canada ..... 206/621.3
472474 9/1937 United Kingdom ..... 206/621.3

*Primary Examiner*—Stephen Marcus
*Assistant Examiner*—Gary E. Elkins
*Attorney, Agent, or Firm*—John P. Moran

[57] ABSTRACT

A flat top, thermoplastic coated, paperboard container having weakened lines formed thereon such that the top may be opened by breaking through a weakened line at the front and progressively breaking the weakened lines along the sides upon peeling back the cover panel, to provide access to the contents. Provisions are included for covering the weakened lines on the inside of the container to prevent leakage.

10 Claims, 2 Drawing Sheets

FLAT TOP CONTAINER AND BLANK FOR CONSTRUCTING SAME

TECHNICAL FIELD

This invention relates generally to thermoplastic coated paperboard containers and, more particularly, to a blank and a container including a top end closure of an improved construction.

BACKGROUND ART

Containers for beverages such as milk, cream, other dairy products, juices, and the like, are conventionally constructed from the thermoplastic coated paperboard. Typically, these containers include a top end closure with a folded roof structure adaptable to providing a readily available pouring spout when the contents of the container are to be dispensed.

Coated paperboard blanks for constructing such a container are made on converting machines similar to those disclosed by Monroe et al U.S. Pat. No. 2,682,208 and Earp U.S. Pat. No. 3,731,600. After construction, the blanks are processed by forming, filling and sealing machines, such as those disclosed by Monroe et al U.S. Pat. No. 3,303,761, Allen U.S. Pat. No. 3,918,236, Egleston U.S. Pat. No. 3,398,659 or Young U.S. Pat. No. 4,193,833, to produce the formed, filled and sealed containers of the type referred to above and shown and described in Egleston et al U.S. Pat. No. 3,270,940 or Lisiecki U.S. Pat. No. 4,422,570.

While this type of container has been generally satisfactory for liquid products, it is desirable to utilize a similar square or rectangular thermoplastic coated paperboard container for frozen juices with a modified top closure arrangement which facilitates pouring after thawing the juice, so as to be able to completely empty the package, in lieu of using a conventional cylindrical plastic or paperboard container with a removable metal or solid plastic top cover. Such a modified top closure arrangement is desirable also for containing and providing access to "spoonable" products, such as yogurt and pudddings. Two examples of a satisfactory top closure of a substantially fully openable type are shown and described in Lisiecki U.S. Pat. No. 4,397,415 and Lisiecki U.S. patent application Ser. No. 868,463.

DISCLOSURE OF THE INVENTION

A general object of the invention is to provide a thermoplastic coated paperboard container including improved top closure means for providing the above mentioned desirable openable and pourable features for particular products.

Another object of the invention is to provide an improved thermoplastic coated paperboard container suitable for being filled with a juice concentrate and then frozen, or with foodstuffs of a somewhat solid consistency.

A still further object of the invention is to provide an improved square or rectangular paperboard container including an improved, conveniently openable and readily pourable flat top closure arrangement.

A still further object of the invention is to provide an improved flat top container having a lift flap and a cover panel having a perforated portion covered with a foil patch, a thermoplastic film, or a thermoplastic hot melt.

Other objects and advantages of the invention will become more apparent when reference is made to the following drawings and related description.

BEST MODE OF CARRYING OUT THE INVENTION

Figure 1:
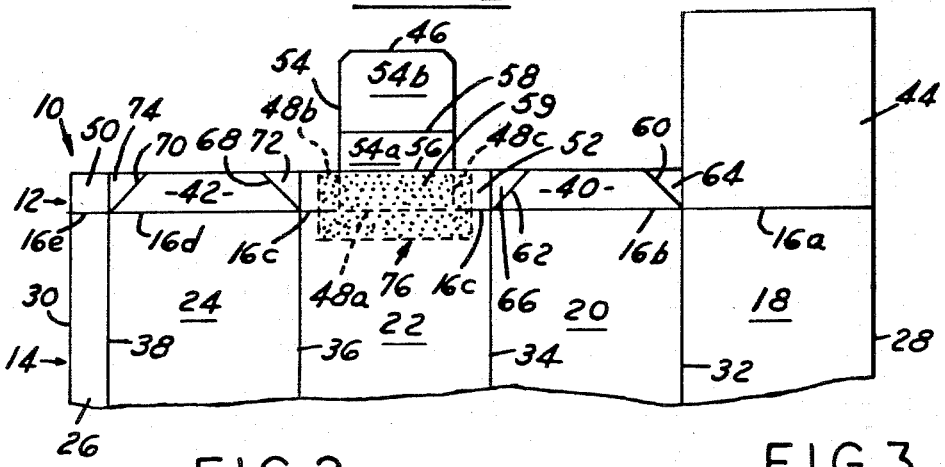
FIG. 1 is a fragmentary layout view of the inside surface of a coated paperboard container blank used to construct a container having a top end closure in accordance with the present invention.

Referring now to the drawings in greater detail, FIG. 1 illustrates a container blank 10 formed in accordance with the principles of the present invention. The container blank 10 is generally divided into three sections including a top end closure 12, a body portion 14, and a conventional flat bottom end closure (not shown). The latter may be any suitable end closure arrangement and is not a part of this invention.

More specifically, horizontal score lines **16*a*, 16*b*, 16*c*, 16*d* and 16*e* extend transversely across the container blank 10 and separate the top end closure 12 and the body portion 14. Likewise, bottom horizontal score lines (not shown) extend transversely across the container blank 10 and separate the bottom end closure (not shown) and the body portion 14**.

The body portion 14 comprises a plurality of integrally connected body panels, namely a back panel 18, a side panel 20, a front panel 22 and a side panel 24, and a side seam flap or narrow fifth panel 26 formed adjacent the panel 24. The container blank 10 is defined on its longitudinal sides by edges 28 and 30. The body panel 18, 20, 22 and 24, and the side seam flap 26, are defined by vertical score lines 32, 34, 36 and 38. It should be apparent that the body panels may be equal in width and hence, adaptable to forming a square cross-section container, or may be formed such that one pair of alternate body panels is wider than the other pair and, hence, adaptable to forming a rectangular cross-section container.

The top closure 12 comprises side fold-in edge panels 40 and 42. The panels 40 and 42 are connected by the score lines **16*b* and 16*d* to the upper ends of the body panel members 20 and 24, respectively. A cover panel 44 and a front edge panel 46 are connected by the score lines 16*a* and 16*c* to the body panel 18 and 22, respectively. A perforated line 48*a* is formed as a central portion of the horizontal score line 16*c*. A further panel 50** is connected by the score line 16e to the upper end of the side seam flap 26.

The front edge panel 46 includes a fold-in segment 52 connected to the body panel 22 by the score line 16c and perforated line 48a, and a narrower segment 54 extending from the panel segment 52, with a horizontal score line 56 formed therebetween. A further horizontal score line 58 is formed across the panel segment 54 at a distance from the score line 56 substantially equal to the height of the segment 52, separating the segment 54 into a fold-out portion 54a and a fold-over portion 54b, the latter to become a lift tab as will be explained.

Vertical perforated lines 48b and 48c extend across the panel segment 52 from the respective ends of the perforated line 48a to the edge of the segment 52 adjacent the ends of the horizontal score line 56, defining an enclosed portion 59.

Diagonal score lines 60 and 62 are formed on the side fold-in edge panel 40 extending from the intersections of the score lines 32/16b and 34/16b, respectively, resulting in the formation of triangular fold-over panel portions 64 and 66. Diagonal score lines 68 and 70 are formed on the side fold-in edge panel 42, extending from the intersections of the score lines 36/16d and 38/16d, respectively, resulting in the formation of triangular fold-over panel portions 72 and 74.

A layer 76 of a suitable material, such as a thermoplastic hot melt, or a strip of either aluminum foil or thermoplastic film, is secured to all the inside surfaces adjacent the perforated lines 48a, 48b and 48c. Specifically, the layer or strip 76 substantially covers the panel segment 52 from a line intermediate the score line 36 and the perforated line 48b to a line intermediate the perforated line 48c and the score line 34, and the upper portion of the front panel 22 just below and for an area substantially equal to the area covered on the panel segment 52.

Figure 2:
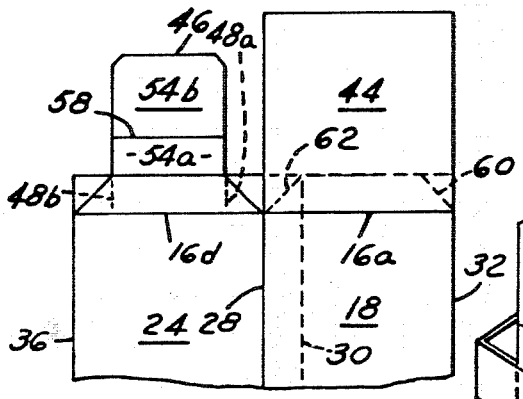
FIG. 2 is a fragmentary layout view of the outside surface of a blank after it is side seamed from the blank illustrated in FIG. 1.

The container blank 10 illustrated in FIG. 1 is first formed into a side seam blank as shown in FIG. 2 by rotating the body panel 24 and the side seam flap 26 as a unit about the vertical score line 36, and having the inside surfaces of the body panel 22, with the vertical score line 38, positioned next to the vertical score lines 34, and with the inside surface of the side seam flap 26 contacting the inside surface of the body panel 20 adjacent the vertical score line 34. The body panel 18 is then rotated about the vertical score line 32 to bring its inside surface into contact with the inside surface of the body panel 20. The inside surface of the body panel 18 along the portion adjacent the edge 28 comes into contact with the outside surface of the side seam flap 26, and the edge 28 is positioned parallel to and aligned with the vertical score line 38. The various members of a bottom end closure will make similar movements. Insofar as the top end closure 12 is concerned, the side fold-in edge panel 42 overlies the panel segment 52, and a portion of the cover panel 44 overlies the front fold-in edge panel 40. The container blank 10 is then sealed where the inside areas of the body panel 18 and cover panel 44 come into contact with the outside surfaces of the side seam flap 26 and the edge panel 50.

In the FIG. 1 structure, if desired, in the formation of the side seam blank the side seam panel 26 could be sealed to the outside surface of the adjacent back panel 18, rather than to the inner surface thereof as described above.

Inasmuch as the eventual top closure arrangement of the invention is a non-gable, flat top configuration, it has been proven to be more compatible with existing forming, filling and sealing machines to form such top closure first. Then, after filling the container through the open bottom end, the panels associated therewith are closed and sealed in a manner heretofore used for a conventional top closure arrangement.

Figure 3:
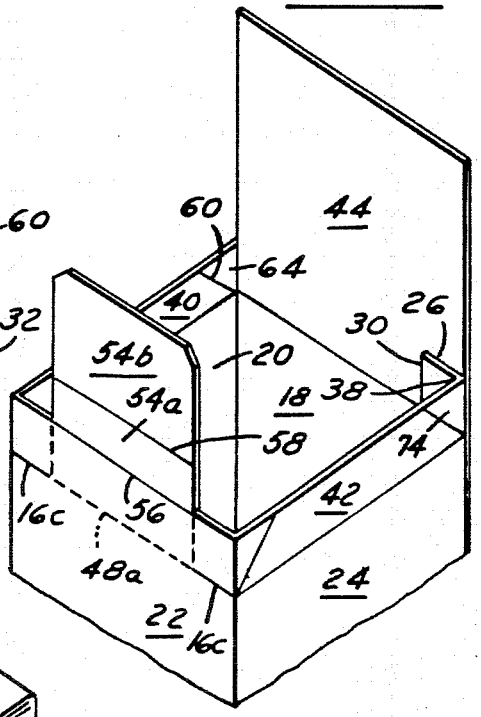
FIGS. 3 and 4 are enlarged fragmentary perspective views illustrating the initial not folded and final completely folded and sealed steps involved in forming the flat top end closure.

Accordingly, after the side seamed blank of FIG. 2 is opened up into a squared condition, as shown in FIG. 3, the various parts of the eventual top end closure 12 are folded on the various score lines and perforated lines in the following manner so as to form the top end structure. The edge panels 40 and 42 are forced inwardly about the respective score lines 16b and 16d, after which the front edge panel 46 is urged inwardly about the score line 16c and perforated line 48a and outwardly about the score line 56, followed by the bending of the cover panel 44 about the score line 16a, after which the panel segment 54b is folded about the score line 58 onto the cover panel 44. In the process, the triangular fold-over panel portions 64, 66, 72 and 74 are folded between the side fold-in edge panel 40 and the cover panel 44, the side fold-in edge panel 40 and the fold-in segment 52, the side fold-in edge panel 42 and the panel 52, and the panel 42 and the fold-in segment 50, respectively.

Figure 4:
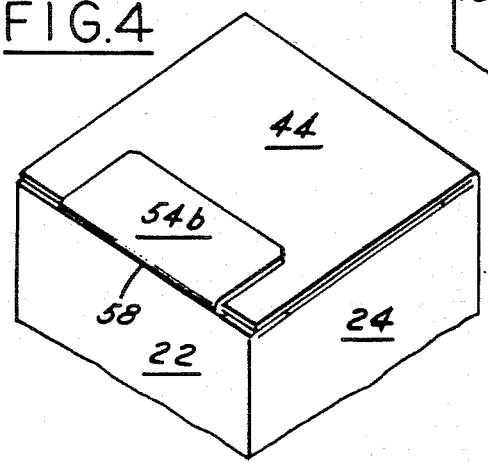

The sealing of the interrelated elements of the top closure 12 is then accomplished by conventional means, such as an ultrasonic or high frequency vibration sealing means. The sealing of the various top end closure elements may also be accomplished by other means, such as gas heat, if desired. FIG. 4 illustrates the top end closure 12 structure once the sealing thereof has been effected. While the cover panel 44 is tightly sealed adjacent the upper ends of the body panels 20, 22 and 24 for a width equivalent to the heights of the panels 40, 42 and 52, the lift tab formed by the panel segment 54b may be merely spot welded to the cover panel 44 for easy release therefrom.

Figure 5:
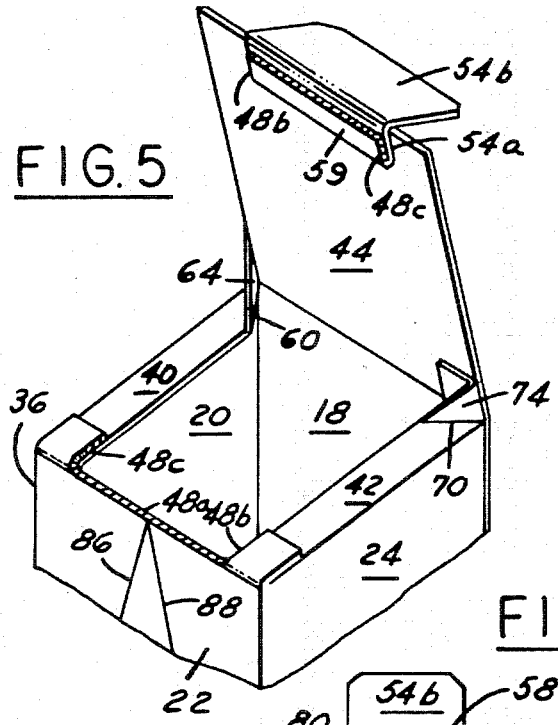
FIG. 5 is a fragmentary perspective view showing the container of FIG. 4 after the top closure has been sealed closed and then opened.
Figure 5A:
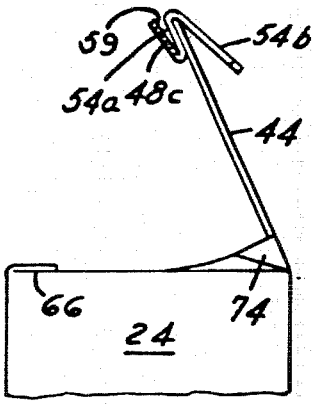
FIG. 5A is a fragmentary side elevational view showing an operational condition of the container as it would look at a location intermediate the FIGS. 4 and 5 views.

In opening the carton, the lift tab 54b is lifted from the cover panel 44 and pulled back, resulting in tension sufficient to cause the rupture of the perforated lines 48b and 48c, then 48a, thereby releasing the enclosed portion 49. As the lift tab 54b is raised further, the cover panel 44 is pulled away from the side edge panels 40 and 42, lifting the triangular fold-over panel portions 64 and 74, and providing an open top as shown in FIG. 5, permitting access to the contents of the container.

Figure 6:
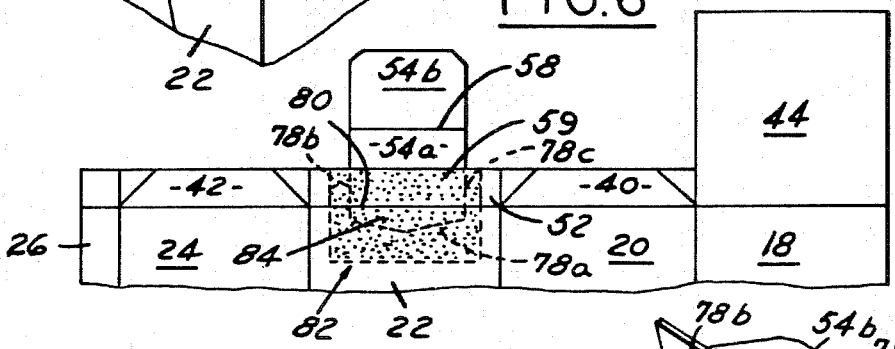
FIG. 6 is a fragmentary layout view of the inside surface of an alternate embodiment blank from which a container embodying the invention may be erected.
Figure 7:
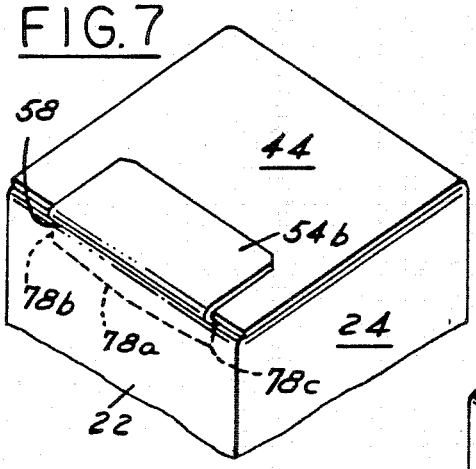
FIGS. 7 and 8 are views of the alternate embodiment comparable to the FIGS. 4 and 5 of the preferred embodiment.
Figure 8:
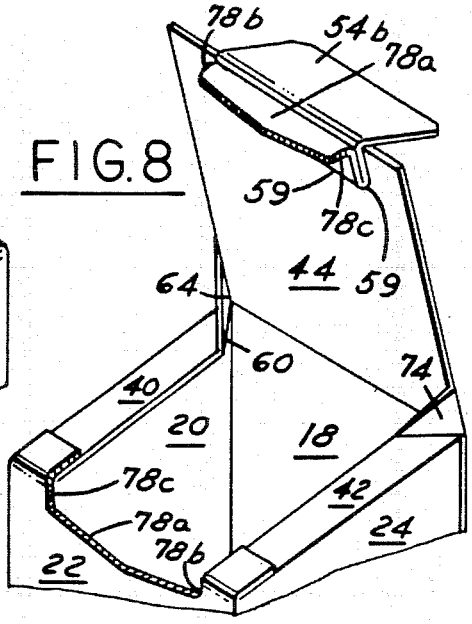

Referring now to FIGS. 6–8, there is illustrated an alternate blank embodiment wherein all elements which are the same as those in FIGS. 1–5 embodiment bear the same reference numerals. However, a score line 80 replaces the combination score line 16c and perforated line 48a, a substantial arcuate perforated line 78a is formed below the central portion of the score line 80, and perforated line 78b and 78c replace the perforated lines 48b and 48c, respectively, and connect with the substantially arcuate perforated line 78a. In this arrangement, the perforated line 78a and the end potions of the perforated lines 78b and 78c are formed on the upper portion of the front panel 22. A layer 82, comparable to the layer 76 is extended further down on the front panel 22 to thoroughly cover the arcuate perforated line 78a. Besides the enclosed portion 59, the perforated lines 78a, 78b and 78c now additionally enclose a segment 84 at the upper end of the front panel 22.

While forming and sealing the FIGS. 6–8 embodiment is accomplished in the same manner as for the FIGS. 1–5 embodiment, when opening, the enclosed segment 84 defined by the arcuate perforated line 78*a*, the score line 80, and the end portions of the perforated lines 78*b* and 78*c*, is first pressed inwardly, breaking the perforated line 78*a* and the ends of the perforated lines 78*b* and 78*c* and bending the segment 84 about the score line 80. Thereafter, the opening process is completed in the same manner as for the FIGS. 1–5 embodiment.

It should be realized that if the carton filled with a frozen concentrate were left out of the freezer over night, or if it were placed in a microwave oven, the contents would melt and thus become pourable. To aid in the pouring process, diverging score lines 86 and 88 may be formed on the front panel 22, as illustrated in FIG. 5, beginning at the top center of the front panel 22. By squeezing the edges formed by the vertical score lines 34 and 36, a pouring spout would be formed at the apex of the diverging score lines 86 and 88.

INDUSTRIAL APPLICABILITY

It should be apparent that the invention provides a novel and efficient thermoplastic coated paperboard carton which is ideally suited for being filled with a frozen concentrate, such as orange juice, or with a spoonable product, such as yogurt and puddings, for example, and sealed for distribution through the marketing system, and capable of being readily and easily opened by the consumer. Whether the cartons are spooned out or poured, the side fold-in edge panels have not been found to present an interference in the emptying process.

It is believed to be important to note that if the perforated lines 48*a*, 48*b* and 48*c*, and 78*a*, 78*b* and 78*c* were formed first on the central paperboard layer, and the conventional thermoplastic coating, such as polyethylene, added thereafter, it would be possible to omit the layers 76 and 82 from the blanks of FIGS. 1 and 6.

It should also be apparent that the invention provides a flat top container closure including a releasable lift tab and perforated lines formed on underlying panel segments, wherein the lifting of the lift tab provides a tension pull on the perforated lines to break same and permit opening the flat top closure.

It should be further apparent that the lift tab described relative to the inventive flat top closure arrangement could, if desired, be folded downwardly and secured to the top edge portion of the front cover in lieu of being secured to the cover panel.

While two embodiments of the invention have been shown and described, other modification thereof are possible within the scope of the following claims.

The embodiments of the invention in which an exclusive property or privilege is claimed are defined as follows:

1. On a thermoplastic coated container including body panels consisting of front and back panels and a pair of side panels, each having a top end; a pair of side fold-in edge panels integrally connected by first and second horizontal score lines to the top end of said pair of side panels and folded on said first and second horizontal score lines inwardly toward one another; a front fold-in panel integrally connected by a third horizontal score line to the top end of said front panel; a fold-out panel segment connected by a fourth horizontal score line to an intermediate portion of said front fold-in edge panel and folded on said fourth score line onto said intermediate portion of said front fold-in edge panel; a lift tab connected by a fifth horizontal score to said fold-out panel segment; and a cover panel integrally connected by a sixth horizontal score line to said back body panel and folded on said sixth horizontal score line onto said side fold-in edge panels and to said front fold-out panel segment and the outer portions of said front fold-in panel segment; the improvement comprising a first perforated line being formed on the top end of said front body panel along an intermediate portion of said third horizontal score line for operative cooperation with said fourth horizontal score line, said first perforated line being substantially equal in length to the width of said fold-out panel segment, and a pair of parallel perforated score lines extending from said first perforated line across said front fold-in edge panel, said fold-out panel segment and said lift tab being aligned with said front fold-in panel intermediate said parallel perforated lines; said parallel perforated lines and said first perforated line being adapted to rupture under tension upon the lifting of said lift tab to thereby lift said front fold-in panel intermediate said parallel perforated lines, said fold-out panel segment and said cover panel in unison and peel said cover panel away from said side fold-in edge panels to fully open said container between said side fold-in edge panels.

2. The container described in claim 1, and a layer of one of aluminum foil, thermoplastic film and hot melt covering the first perforated line and said pair of parallel perforated lines.

3. The container described in claim 1, wherein said first perforated line is aligned with said third horizontal score line and forming a central portion thereof at the top end of said front panel.

4. The container described in claim 1, wherein said first perforated line is substantially an arcuate line extending downwardly from the third horizontal score line, being formed on said front panel and adapted to being pushed inwardly to be broken.

5. The container described in claim 1, and a pair of diagonal score lines formed on each of said side fold-in edge panels, each said pair of diagonal score lines converging in an upwardly direction and forming corner segments sealed between said fold-in edge panels and said cover panels.

6. On a thermoplastic coated container blank including body panels consisting of front and back panels and a pair of side panels, each having a top end; a pair of side fold-in edge panels integrally connected by first and second horizontal score lines to the top end of said pair of side panels; a front fold-in panel integrally connected by a third horizontal score line to the top end of said front panel; a fold-out panel segment connected by a fourth horizontal score line to said front fold-in edge panel; a lift tab connected by a fifth horizontal score to said fold-out panel segment; and a cover panel integrally connected by a sixth horizontal score line to said back body panel; the improvement comprising a first perforated line being formed on the top end of said front body panel along said third horizontal score line for operative cooperation with said fourth horizontal score line, said first perforated line being centrally located and narrower than the width of said front body panel, and a pair of parallel perforated score lines extending from said first perforated line across said front fold-in edge panel, said fold-out panel segment and said lift tab being substantially the same width as said first perforated score line and aligned with said front fold-in panel intermediate said parallel perforated lines; said parallel perforated lines being spaced from the respective adjacent side fold-in edge panels a distance substantially equal to the height of said side fold-in edge panels.

7. The blank described in claim 6, and a layer of one of aluminum foil, thermoplastic film or hot melt covering the first perforated line and said pair of parallel perforated lines.

8. The blank described in claim 6, wherein said first perforated line is aligned with said third horizontal score line and forming a central portion thereof at the top end of said front panel.

9. The blank described in claim 6, wherein said first perforated line is substantially an arcuate line extending downwardly from the third horizontal score line, being formed on said front panel and adapted to being pushed inwardly to be broken.

10. The blank described in claim 6, and a pair of diagonal score lines formed on each of said side fold-in edge panels, each said pair of diagonal score lies converging in an upwardly direction and forming corner segments sealed between said fold-in edge panels and said cover panel.

* * * * *